US008320792B2

(12) United States Patent
Kawakami et al.

(10) Patent No.: US 8,320,792 B2
(45) Date of Patent: Nov. 27, 2012

(54) CLEANING DEVICE, PROCESS CARTRIDGE, AND IMAGE FORMING APPARATUS

(75) Inventors: Yoshihiro Kawakami, Itami (JP); Hirobumi Ooyoshi, Toyonaka (JP); Osamu Saito, Toyonaka (JP)

(73) Assignee: Ricoh Company, Ltd., Tokyo (JP)

( * ) Notice: Subject to any disclaimer, the term of this patent is extended or adjusted under 35 U.S.C. 154(b) by 307 days.

(21) Appl. No.: 12/458,574

(22) Filed: Jul. 16, 2009

(65) Prior Publication Data

US 2010/0028045 A1 Feb. 4, 2010

(30) Foreign Application Priority Data

Jul. 29, 2008 (JP) ..... 2008-195223

(51) Int. Cl.
*G03G 15/08* (2006.01)
*G03G 21/00* (2006.01)

(52) U.S. Cl. ..... 399/102; 399/350; 399/351

(58) Field of Classification Search ..... 399/102
See application file for complete search history.

(56) References Cited

U.S. PATENT DOCUMENTS

| | | | | |
|---|---|---|---|---|
| 5,455,665 | A * | 10/1995 | Baba et al. | 399/358 |
| 5,502,547 | A * | 3/1996 | Shirai | 399/102 |
| 6,658,223 | B2 * | 12/2003 | Nishimura et al. | 399/102 |
| 7,873,302 | B2 | 1/2011 | Kawakami et al. | |
| 2004/0208668 | A1 * | 10/2004 | Kurihara et al. | 399/102 |
| 2006/0251445 | A1 * | 11/2006 | Ueno et al. | 399/102 |
| 2008/0019720 | A1 | 1/2008 | Kawakami et al. | |
| 2008/0152408 | A1 | 6/2008 | Kawakami et al. | |
| 2008/0205930 | A1 | 8/2008 | Kawakami et al. | |

FOREIGN PATENT DOCUMENTS

| | | |
|---|---|---|
| JP | 06195000 A | 7/1994 |
| JP | 8-123285 | 5/1996 |
| JP | 8-292693 | 11/1996 |
| JP | 2004-037638 | 2/2004 |
| JP | 2005-043539 | 2/2005 |
| JP | 2006-251145 | 9/2006 |
| JP | 2008152155 A | 7/2008 |

OTHER PUBLICATIONS

Japanese communication issued by the JPO dated Jul. 13, 2012 for corresponding Japanese Application No. 2008-195223.

* cited by examiner

*Primary Examiner* — Walter L Lindsay, Jr.
*Assistant Examiner* — David Bolduc
(74) *Attorney, Agent, or Firm* — Harness, Dickey & Pierce, P.L.C.

(57) ABSTRACT

A cleaning device includes a casing including an opening facing the rotary member, a cleaning member disposed at the opening to contact the rotary member to remove a substance adhering thereto, an entrance seal disposed at the opening to prevent leakage of the removed substance through a gap between the opening and the rotary member, a pair of lateral end seals respectively disposed both end portions of the cleaning member as well as the entrance seal in an axial direction of the rotary member, and a compressing member. A first face of each lateral end seal is attached to the casing. The compressing member compresses each lateral end seal by pressing a second face thereof opposite the first face-and presses a third face of the lateral end seal against the casing in a direction in which the lateral end seal is expanded by the compression.

15 Claims, 7 Drawing Sheets

CLEANING DEVICE, PROCESS CARTRIDGE, AND IMAGE FORMING APPARATUS

CROSS-REFERENCE TO RELATED APPLICATIONS

This patent specification is based on and claims priority from Japanese Patent Application Nos. 2008-195223, filed on Jul. 29, 2008 in the Japan Patent Office, the entire contents of,which are hereby incorporated by reference herein.

BACKGROUND OF THE INVENTION

1. Field of the Invention

The present invention generally relates to a cleaning device to clean a surface of a rotary member, a process cartridge including the cleaning device, and an image forming apparatus including the process cartridge.

2. Discussion of the Background Art

In general, electrophotographic image forming apparatuses, such as copiers, printers, facsimile machines, multifunction machines including at least two of those functions, etc., form an electrostatic latent image on an image carrier, develop the latent image, transfer the developed image (toner image) onto a sheet of recording media, and then fix the toner image with heat and pressure thereon.

In such image forming apparatuses, typically, the image carrier, a charging device to charge a surface of the image carrier, a developing device to develop the latent image on the surface of the image carrier with developer, a cleaning device to clean the surface of the image carrier after the toner image is transferred therefrom, and the like are housed in a single process cartridge that is detachably attachable to the image forming apparatus to facilitate maintenance of these devices.

Such process cartridge including the cleaning device is described in detail below with reference to FIGS. 10A, 10B, and 11.

FIG. 10A is a schematic cross-sectional view illustrating a cleaning device 20X viewed from an axial direction of an image carrier 100, and FIG. 10B schematically illustrates the cleaning device 20*x* viewed from a direction indicated by arrow C shown in FIG. 10A perpendicular to the axial direction of the image carrier 100. It is to be noted that a casing 200 that houses the cleaning device 20*x*, although shown in FIG. 10A, is omitted in FIG. 10B for simplicity.

As shown in FIGS. 10A and 10B, the cleaning device 20*x* includes the casing 200, in which an opening 200*a* facing the image carrier 100 is formed; a cleaning blade 300; an entrance seal 400; and a pair of lateral end seals 500. The cleaning blade 300 and the entrance seal 400 are attached to the opening 200*a* so as to face each other. As shown in FIG. 10B, each end seal 500 is disposed to closely contact an edge portion of the cleaning blade 300 as well as an edge portion of the entrance seal 400.

As shown in FIG. 11, the cleaning blade 300, the entrance seal 400, and the end seals 500 are pressed against a surface of the image carrier 100. As the image carrier 100 rotates in a direction indicated by arrow D shown in FIG. 11, toner, dust, and the like (hereinafter simply "toner T") adhering to the surface of the image carrier 100 passes the entrance seal 400 and then reaches an edge portion of the cleaning blade 300, where the toner T is removed from the image carrier 100. Then, the toner T is stored in the casing 200.

The function of the seals 400 and 500 is to prevent toner from leaking. More specifically, the entrance seal 400 allows the toner T to pass only in a direction in which the image carrier rotates (hereinafter "image carrier rotation direction") and does not allow the toner T to pass a direction opposite thereto, thus preventing leakage of the toner T removed from the image carrier 100. In addition, the end seals 500 prevent the toner T from leaking from the edge portions of the cleaning blade 300 and the entrance seal 400.

However, when the end seals 500 are attached to the casing 200, it can happen that a gap S is created between each end seal 500 and the casing 200 as shown in FIG. 12 due to dimensional tolerance and/or assembly tolerance, and the toner T removed from the image carrier 100 can leak through the gap S. If the toner T then enters an image forming unit, image failure might occur. Moreover, if the toner T accumulates inside the image forming apparatus, the toner T might scatter during maintenance work, which is harmful to operators as well as damaging to the image forming apparatus.

Several approaches, described below, have been advanced to eliminate the gap between the end seal and the casing of the cleaning device.

For example, in certain known cleaning devices, filler is used to eliminate the gap between the end seal and the casing.

However, in this case, because applying the filler to the gap and hardening the filler are required, the manufacturing process is rather complicated, and accordingly, assembling the cleaning device requires a longer time. Moreover, because applying the filler to the gap is a delicate operation, the gap might be filled with the filler incompletely, and/or the filler might accidentally adhere to the cleaning blade. If the filler is sandwiched between the image carrier and the cleaning blade, significant image failure can occur.

In other known cleaning devices, a back surface of the end seal is attached to a casing of the cleaning device using double-sided adhesive tape. However, the double-sided adhesive tape is not applied to a given area of the back surface of the end seal, and the portion where the adhesive tape is not present is pressed against an edge surface of the casing so that no gap is created between the end seal and the edge surface of the casing.

In this case, although the end seal can be attached to the casing relatively easily, it is difficult to eliminate the gap between the end seal and the edge surface of the casing completely, and thus this approach does not provide a complete solution to the problem of toner leakage.

In view of the foregoing, a need has arisen to prevent the leakage of the toner from the cleaning device with a simple configuration, which known cleaning devices fail to do.

SUMMARY OF THE INVENTION

In view of the foregoing, one illustrative embodiment of the present invention provides a cleaning device for a rotary member. The cleaning device includes a casing including an opening facing the rotary member, a cleaning member disposed at the opening in the casing to contact a surface of the rotary member and to remove a substance adhering thereto, an entrance seal provided at the opening in the casing and disposed upstream from the cleaning member in a direction in which the rotary member rotates to prevent leakage of the substance removed by the cleaning member through a gap between the opening in the casing and the rotary member, a pair of lateral end seals, and a compressing member. The lateral end seals are provided at the opening in the casing and are respectively disposed both end portions of the cleaning member as well as the entrance seal in an axial direction of the rotary member to prevent leakage of the substance removed by the cleaning member from the both end portions, and a first face of each lateral end seal is attached to the casing. The compressing member compresses each lateral end seal by pressing a second face thereof opposite the first face against the casing and presses a third face of the lateral end seal perpendicular to the first face and the second face of the lateral end seal against a first surface of the casing in a direction in which the lateral end seal is expanded by the compression.

In another illustrative embodiment of the present invention, a process cartridge includes a housing, an image carrier on which a toner image is formed, and the cleaning device described above. The image carrier and the cleaning device are disposed within the housing of the process cartridge.

Yet in another illustrative embodiment of the present invention, an image forming apparatus includes the process cartridge described above, and a transfer unit to transfer the toner image from the image carrier onto a sheet of recording media.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
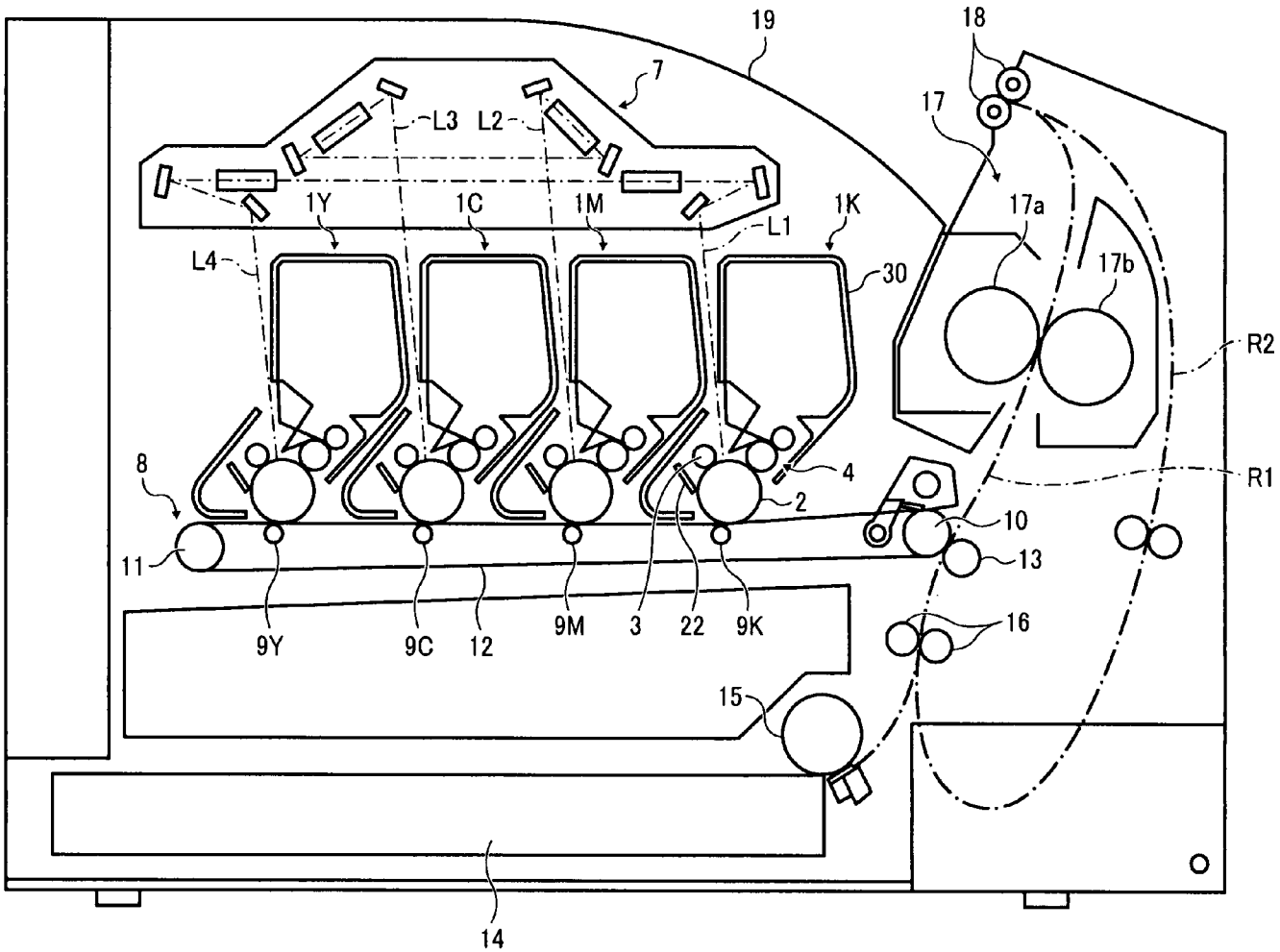
FIG. 1 illustrates a configuration of an image forming apparatus according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a color image forming apparatus according to an illustrative embodiment of the present invention is described.

Referring to FIG. 1, the image forming apparatus includes four process cartridges 1K, 1M, 1C, and 1Y that form different single-color images with black, magenta, cyan, and yellow toners respectively. These are the colors decomposed from multicolor images. The process cartridges 1K, 1M, 1C, and 1Y are detachably attachable to the image forming apparatus and have a similar configuration except the color of the toner contained therein.

It is to be noted that reference character suffixes K, M, C, and Y represent black, magenta, cyan, and yellow respectively, and may be omitted in the description below when color discrimination is not required.

Each process cartridge 1 includes an image carrier 2 on which an electrostatic latent image is formed, a charging device 3, a developing device 4, and a cleaning blade 22 all of which housed in a housing 30. The image carrier 2 can be a photoreceptor drum or an endless photoreceptor belt. The charging device 3 includes a charging roller disposed to contact a surface of the image carrier 2. Alternatively, charging device 3 can be a corona discharge type that is disposed with a space from the surface of the image carrier 2. The developing device 4 includes a supply roller to supply toner to the image carrier 2. The cleaning blade 22 serves as a cleaning member that removes toner, dust, and the like from the surface of the image carrier 2.

The housing 30 of each process cartridge 1 can be injection-molded resin. Examples of the material of the housing 30 includes, but not limited to, polycarbonate resin, acrylic nitrile butadiene styrene resin, nitrile styrene resin, polyphenylene oxide resin, polyether terephthalate resin, and alloy resin including one or more of these resins.

Above the process cartridges 1, an exposure unit 7 is disposed. The exposure unit 7 is configured to emit laser lights L1 through L4 from laser diodes according to image data.

Beneath the process cartridges 1, a transfer unit 8 is provided. The transfer unit 8 includes an intermediate transfer belt 12 and four primary transfer rollers 9 disposed facing the respective image carriers 2. The intermediate transfer belt 12 is wound around the primary transfer rollers 9, a driving roller 9, and a tension roller 11 and is rotatable. The intermediate transfer belt 12 contacts the four image carriers 2. The primary transfer rollers 9 transfer toner images from the respective image carriers 2 onto the intermediate transfer belt 12 in respective primary transfer nips where the intermediate transfer belt 12 contacts the respective image carriers 2.

The transfer unit 8 further includes a secondary transfer roller 13 disposed facing the driving roller 10 via the intermediate transfer belt 12. The secondary transfer roller 13 presses against the intermediate transfer belt 12, and the toner image is transferred from the intermediate transfer belt 12 onto a sheet of recording media in a secondary transfer nip where the secondary transfer roller 13 presses against the intermediate transfer belt 12.

In a lower portion of the image forming apparatus, a sheet cassette 14 that accommodates multiple sheets of recording media and a feed roller 15 to feed the sheets from the sheet cassette 14 are provided. The sheet fed from the sheet cassette 14 is transported upward in FIG. 1 along a transport path R1 formed in the image forming apparatus.

Along the transport path R1, a pair of registration rollers 16 to stop the sheet is provided upstream from the secondary transfer nip between the secondary transfer roller 13 and the driving roller 10 in a direction in which the sheet is transported (hereinafter "sheet transport direction"). Further, a fixing device 17 is provided downstream from the secondary transfer nip in the sheet transport direction, which is in an upper portion in FIG. 1. The fixing device 17 includes a fixing roller 17*a* and a pressure roller 17*b*.

A pair of discharge rollers 18 is disposed in a downstream end portion of the transport path R1 in the sheet transport direction. The discharge rollers 18 discharge the sheet onto a discharge tray 19 that is a recessed portion formed on an upper face of the image forming apparatus.

The image forming apparatus according to the present embodiment further includes a controller, not shown, to control various operations thereof and a reverse path R2 though which the sheet is reversed to form images on both sides of the sheet. The reverse path R2 branches off from the transport path R1 upstream from the downstream end portion of the transport path R1 and then merges to the transport path R1 upstream from the registration rollers 16. The discharge rollers 18 also serve as switchback rollers that rotate in reverse to the direction in which the sheet is discharged to the discharge tray 19, thereby forwarding the sheet to the reverse path R2.

Now, basic operations of the above-described image forming apparatus are described below with reference to FIG. 1.

In the process cartridge 1K, the charging device 3 charges the surface of the image carrier 2 uniformly to a high electrical potential. Then, the exposure unit 7 directs the laser light L1 onto the surface of the image carrier 2 according to image data, and the electrical potential decreases in portions of the image carrier 2 exposed to the laser light L1, thus forming an electrostatic latent image thereon. Subsequently, the developing device 4 supplies black toner to the electrostatic latent image, thus developing it into a black toner image.

Similarly, magenta, cyan, and yellow images are respectively formed in the process cartridges 1M, 1C, and 1Y.

The primary transfer roller 9K receives a constant voltage or constant-current voltage whose polarity is opposite that of the toner, and then a transfer electrical field is formed in the primary transfer nip between the primary transfer roller 9K and the image carrier 2. The four single-color toner images are sequentially transferred from the respective image carriers 2 with the effects of the transfer electrical field and are superimposed one on another on the intermediate transfer belt 12, which is a primary transfer process. Thus, a multicolor image is formed on the intermediate transfer belt 12.

After the primary transfer process, the cleaning blade 22 serving as the cleaning member cleans the surface of the image carrier 2.

While, the feed roller 15 is rotated according to a sheet feed signal transmitted from the controller, not shown, and feeds the sheets stored in the sheet cassette 14 one by one from the top. The sheet is transported along the transport path R1, and then the registration rollers 16 stop the sheet.

After the toner images are primarily transferred onto the intermediate transfer belt 12, the registration rollers 16 start rotating to forward the sheet to the secondary transfer nip, timed to coincide with the multicolor toner image on the intermediate transfer belt 12.

At the secondary transfer nip, the secondary transfer roller 13 receives a voltage whose polarity is opposite that of the toner image, and thus a transfer electrical field is formed therein. Alternatively, a voltage whose polarity is identical to that of the toner image can be applied to the driving roller 10 that faces the secondary transfer roller 13 so as to form a similar transfer electrical field. Then, the multicolor toner image on the intermediate transfer belt 12 is secondarily transferred onto the sheet with the effects of the transfer electrical field, which is a secondary transfer process.

After the secondary transfer process, the sheet is transported to the fixing device 17 and sandwiched between the fixing roller 17*a* and the pressure roller. 17*b*. Then, the toner image is fixed on the sheet with heat and pressure, after which the sheet is discharged by the discharge rollers 18 onto the discharge tray 19.

In duplex printing, after the image formed on a first side (front side) of the sheet is thus fixed, the discharge rollers 18 rotate in reverse to forward the sheet to the reverse path R2. While passing through the reverse path R2, the sheet is reversed, and again transported to the transport path R1 with its second side (back side) faced up. Then, a toner image is formed on the second side of the sheet and fixed thereon through processes similar to those described above, after which the sheet is discharged onto the discharge tray 19.

Next, descriptions will be made below of cleaning devices for the respective image carriers 2, which is a distinctive feature of the present embodiment.

Figure 2A:
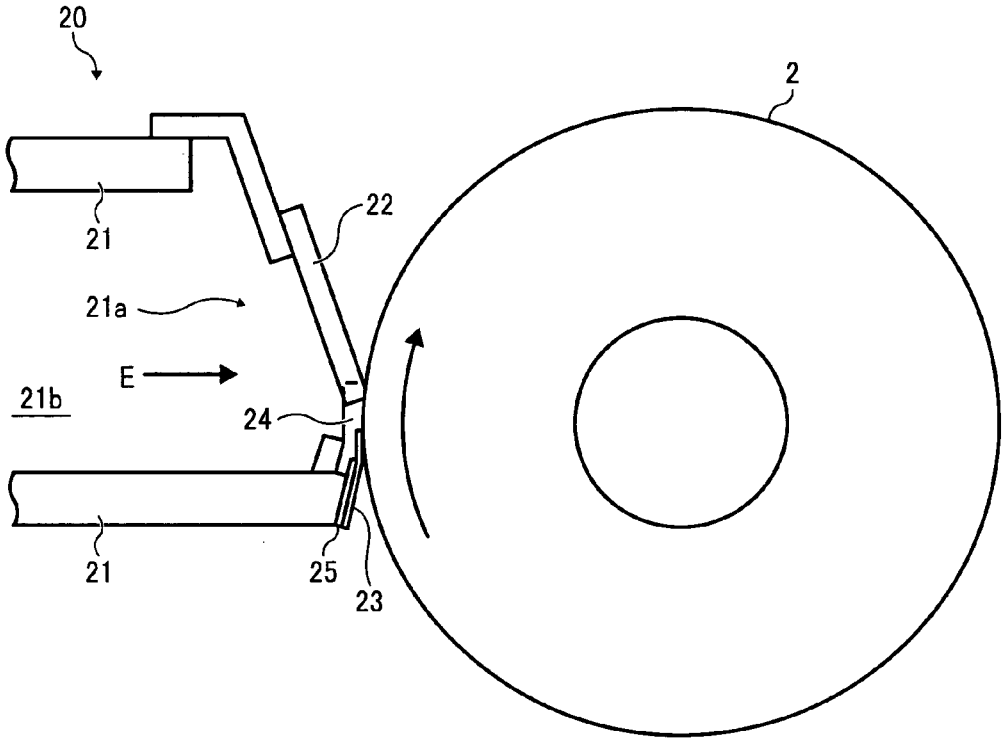
FIG. 2A is a cross-sectional view illustrating a cleaning device viewed from an axial direction of an image carrier.
Figure 2B:
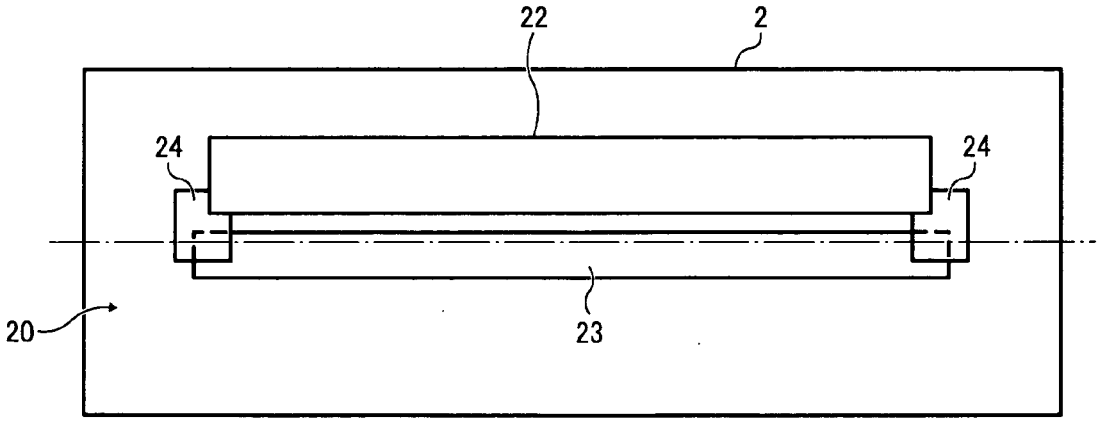
FIG. 2B illustrates the cleaning device viewed from a direction perpendicular to the axial direction of the image carrier.

FIG. 2A is a schematic cross-sectional view of the cleaning device viewed from an axial direction of the image carrier 2, and FIG. 2B schematically illustrates the cleaning device viewed from a direction indicated by arrow E shown in FIG. 2A, which is perpendicular to the axial direction of the image carrier 2.

As shown in FIGS. 2A and 2B, a cleaning device 20 includes a casing 21 in which an opening 21*a* that faces the image carrier 2 is formed, the cleaning blade 22 described above, an entrance seal 23 that seals a gap between the opening 21*a* and the image carrier 2, and a pair of lateral end seals 24. Each end seal 24 seals a lateral end portion of the cleaning blade 22 as well as a lateral end portion of the entrance seal 23, that is, closes the opening 21*a* in an end portion in the axial direction of the image carrier 2.

The casing 21 is integrally formed on the housing 30 of the process cartridge 1 shown in FIG. 1. The casing 21 includes a storage portion 21*b* to store the toner, dust, and the like (hereinafter simply "toner") removed from the image carrier 2, and the storage portion 21*b* includes a transport member, not shown, to transport the removed toner to a container, not shown.

The cleaning blade 22 is shaped like a strip extending in the axial direction of the image carrier 2 and can be formed with rubber or the like. As shown in FIG. 2A, the cleaning blade 22 is attached to an upper portion of the casing 21 above the opening 21*a* in FIG. 2A with a fixing member such as a screw.

The entrance seal 23 is also shaped like a strip extending in the axial direction of the image carrier 2 and attached to a lower portion of the casing 21 beneath the opening 21*a* in FIG. 2A via an adhesive member 25, such as double-sided adhesive tape, that serves as a compressing member to compress the end seals 24. In other words, the entrance seal 23 is disposed upstream from the cleaning blade 22 in a direction shown by an arrow in FIG. 2A, in which the image carrier 2 rotates (hereinafter "image carrier rotation direction").

Each end seal 24 is disposed to closely contact an edge face of the cleaning blade 22 in its longitudinal direction as well as a face of an end portion of the entrance seal 23 in its longitudinal direction. In the present embodiment, the end seals 24 are attached to the lower portion of the casing 21 beneath the opening 21*a* in FIG. 2A.

In addition, as shown in FIG. 2A, each of the cleaning blade 22, the entrance seal 23, and the end seals 24 is disposed to contact an outer circumferential surface of the image carrier 2 when the cleaning device 20 is positioned to a predetermined or given position with respect to the image carrier 2.

Therefore, it is preferable that the entrance seal 23 be formed with a flexible resin sheet so as to enhance the close contact between the entrance seal 23 and the image carrier 2 as well as to reduce damage to the image carrier 2. Examples of the material of the entrance seal 23 include, but not limited to, polyethylene terephthalate resin (PET), polyurethane resin (PUR), polyphenylether resin (PPE), polycarbonate resin (PC), polyethylene resin (PE), and polypropylene resin (PP).

The end seals 24 are preferably soft cushiony seals so that the contact between the end seals 24 and the image carrier 2 neither damages the image carrier 2 nor increases the rotation torque of the image carrier 2. Examples of the material of the end seals 24 include, but not limited to, foamed material, nonwoven fabric, and woven fabric. These materials can be used alone or in combination.

Figure 3:
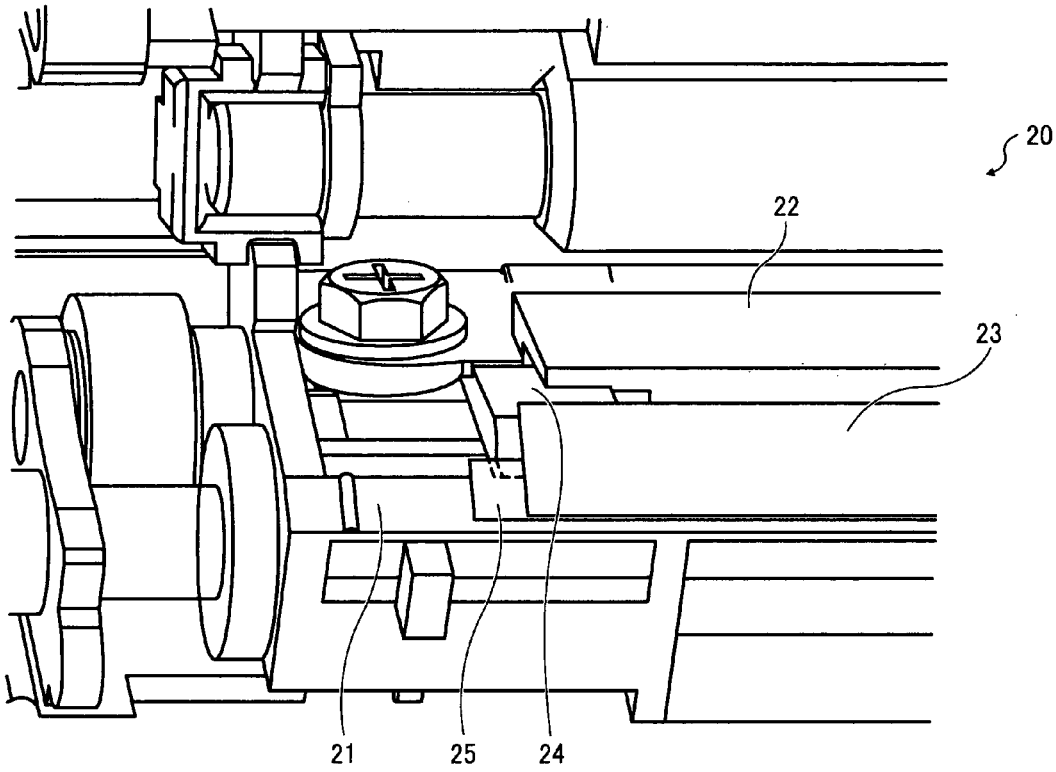
FIG. 3 is a perspective view illustrating a cleaning blade, an entrance seal, and a lateral end seal all of which attached to a casing of the cleaning device shown in FIG. 2A.

Additionally, as shown in FIG. 3, in the cleaning device 20 according to the present embodiment, the end seals 24 are partly pressed by the adhesive member 25 adhering to the casing 21 to attach the entrance seal 23 to the casing 21.

Figure 4A:
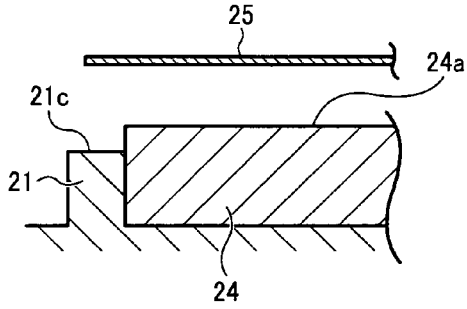
FIG. 4A illustrates a state before an adhesion member is attached to the casing.

FIG. 4A illustrates a state before the adhesive member 25 is attached to the casing 21. The casing 21 includes an adhesive surface 21*c* (second surface) that protrudes from a concavity that engages the end seal 24, that is, the adhesive surface 21*c* is adjacent to the lateral end seal 24. The adhesive member 25 is attached to the adhesive surface 21*c*. To attach the adhesive member 25 to the casing 21, the adhesive member 25 is moved down in FIG. 4A. This direction is referred to as the attachment direction of the adhesive member 25. Then, a second face 24*a* (upper face in FIG. 4A) of the end seal 24 is pushed by the adhesive member 25.

Figure 4B:
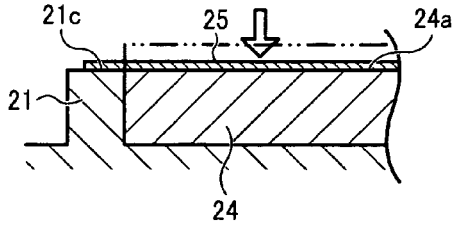
FIG. 4B illustrates the adhesion member attached to the casing.

Subsequently, as shown in FIG. 4B, while compressing the end seal 24, the adhesive member 25 is attached to the casing 21.

In addition, as shown in FIG. 4A, when the end seal 24 is not pressed by the adhesive member 25, the second face 24*a* (pressed face) of the end seal 24 to be pressed by the adhesive member 25 is upstream (upper in FIG. 4A) from the adhesive surface 21*c* of the casing 21, to which the adhesive member 25 is attached, in the attachment direction of the adhesive member 25. Therefore, the end seal 24 can be easily compressed.

Figure 5A:
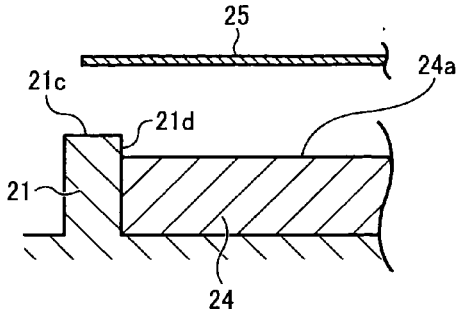
FIG. 5 illustrates a variation of the positional relation among the casing, the lateral end seal, and the adhesion member.
Figure 5B:
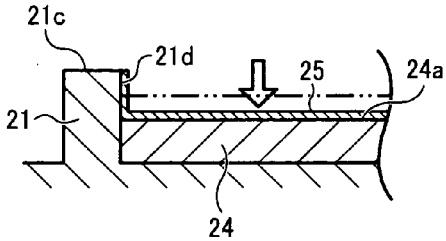

It is to be noted that, as shown in FIG. 5A, even when the second face 24*a* (pressed face) of the end seal 24 is downstream (lower in FIG. 5A) from the adhesive surface 21*c* in the direction in which the adhesive member 25 is attached to the casing 21, the end seal 24 can be compressed by the adhesive member 25 by adhering the adhesive member 25 to a surface 21*d* of the casing 21 as shown in FIG. 5B.

A cleaning device according to another embodiment is described below, referring to FIG. 6.

Figure 6:
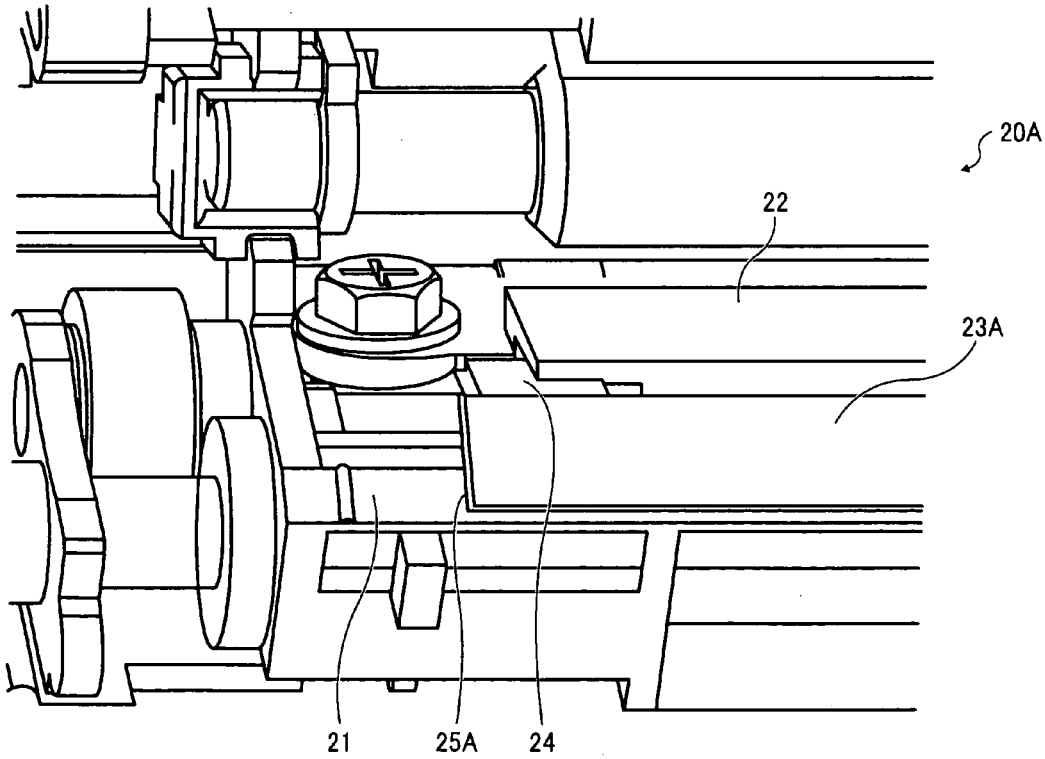
FIG. 6 is a perspective view illustrating a cleaning device according to another embodiment.

Referring to FIG. 6, in a cleaning device 20A, an adhesive member 25A and an entrance seal 23A have an identical or similar shape. Also in this case, the adhesive member 25A presses lateral end seals 24 partly to compress the end seals 24.

Yet another embodiment is described below with reference to FIG. 7.

Figure 7:
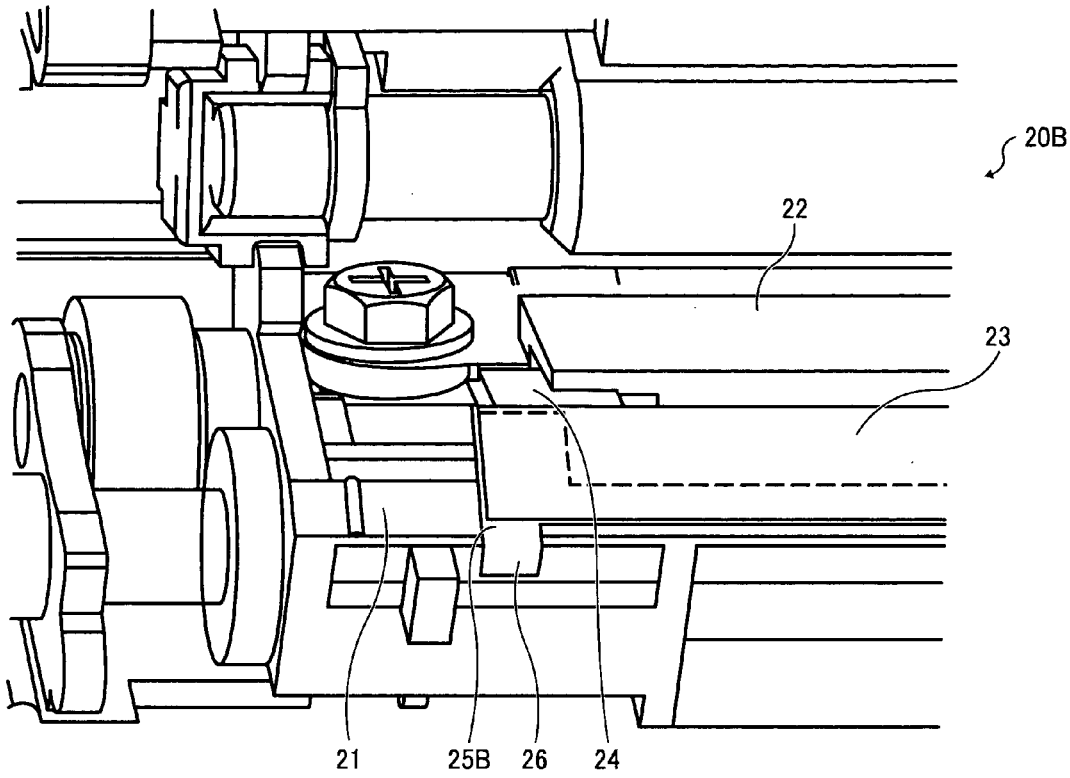
FIG. 7 is a perspective view illustrating a cleaning device according to yet another embodiment.

Referring to FIG. 7, also in a cleaning device 20B according to another embodiment, an adhesive member 25B presses lateral end seals 24 partly to compress the end seals 24.

Further, the adhesive member 25B adhered to the end seal 24 is pulled to the near side in FIG. 7 and attached to the casing 21. With this pulling force, the end seal 24 is also pulled to the near side in FIG. 7 and further pressingly contacts the casing 21. Moreover, the adhesive member 25B includes an extended portion 26 extended to the near side in FIG. 7. By attaching the extended portion 26 to a surface of the casing 21, disposed on the near side, that crosses the direction in which the adhesive member 25B is pulled, the pulling force of the adhesive member 25B can be increases so that the adhesive member 25B is not easily removed from the casing 21.

Herein, when the lateral end seals are attached to the casing of the cleaning device, gaps might be created between the lateral end seals and the casing due to dimensional tolerance and/or assembly tolerance as described above. Therefore, in the various illustrative embodiments of the present invention, the adhesive member presses the lateral end seals partly so as to compress the lateral end seals, which is described in further detail below with reference to FIG. 8.

Figure 8:
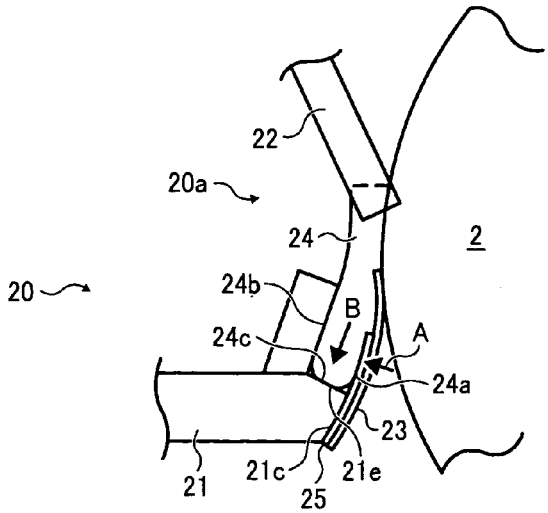
FIG. 8 illustrates effects of the lateral end seal according to the illustrative embodiments.

Referring to FIG. 8, a first face 24*b* of the end seal 24 is attached to the casing 21, and the second face 24*a* (pressed face) thereof opposite the first face 24*b* is pressed by the adhesive member 25 in a direction indicated by arrow A, thereby compressing the end seal 24 in that direction (hereinafter "compression direction"). Accordingly, the end seal 24 expands in a direction indicated by arrow B, which is perpendicular to the compression direction of the end seal 24. Thus, the adhesive member 25 serves as the compressing member to compress the end seals 24 as well as to expand the end seals 24 in the direction perpendicular to the compression direction of the end seal 24.

Then, a third face 24*c* of the expanded end seal 24 presses against a face 21*e* (first surface) of the casing 21 facing the third face 24*c*. Thus, the gap between the end seal 24 and the casing 21 created during attachment of the end seal 24 can be eliminated, preventing or reducing the leakage of the toner from the cleaning device 20.

Although, in the above described embodiments, the end seals 24 are compressed by the adhesive member 25 (double-sided adhesive tape) that is used to attach the entrance seal 23 to the casing 21, the compressing member to compress the end seals 24 is not limited thereto. However, compressing the end seals 24 with the adhesive member 25 can dispense with a separate compressing member to compress the end seals 24, thus reducing the cost and the space of the cleaning device 20. In addition, because attaching the adhesive member 25 to the casing 21 and compressing the end seals 24 can be performed simultaneously, the time required to assemble the cleaning device 20 can be shorter.

Figure 9:
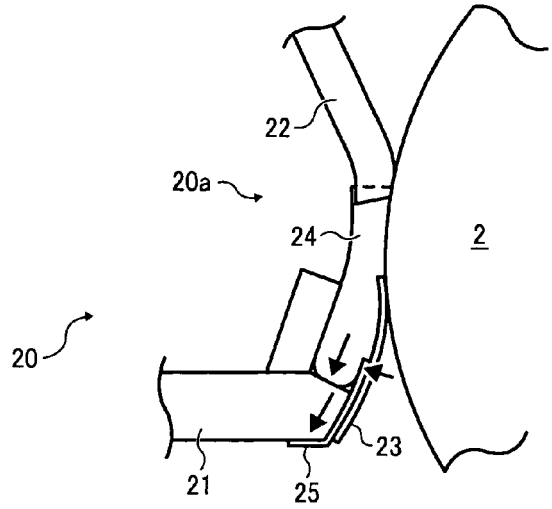
FIG. 9 illustrates attaching the adhesive member to the casing.
Figure 10A:
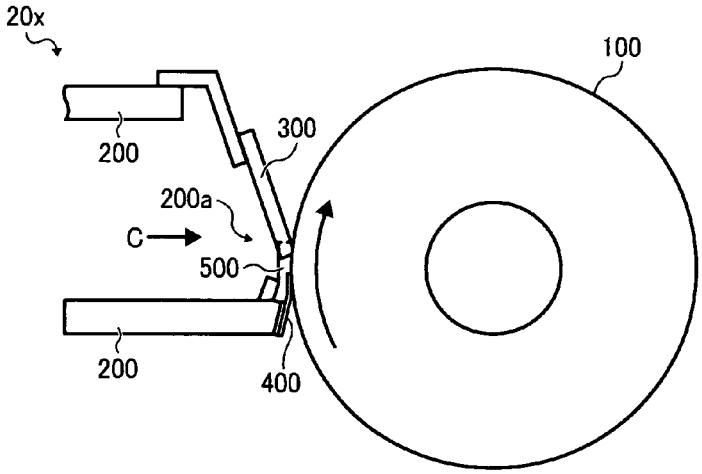
FIG. 10A RELATED ART
FIG. 10A is a cross-sectional view illustrating a known cleaning device viewed from an axial direction of an image carrier.
Figure 10B:
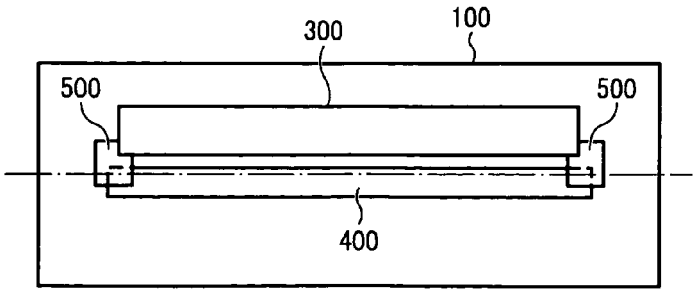
FIG. 10B RELATED ART
FIG. 10B illustrates the known cleaning device viewed from a direction perpendicular to the axial direction of the image carrier.

Moreover, as shown in FIG. 9, when the adhesive member 25 is attached to the casing 21, by compressing the end seal 24 with the adhesive member 25 and simultaneously pulling the adhesive member 25 attached to the end seal 24 in the direction in which the end seal 24 presses against the casing 21, the force of the end seal 24 to press against the casing 21 can be increased. The pulled adhesive tape can be attached to a face of the casing 21 that crosses the direction in which the end seal 24 presses against the casing 21. As a result, the gaps between the end seals 24 and the casing 21 can be surely eliminated.

Figure 11:
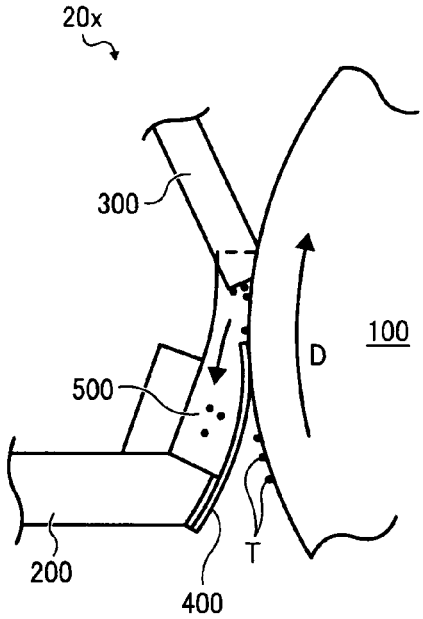
FIG. 11 RELATED ART
FIG. 11 illustrates operations of the known cleaning device.
Figure 12:
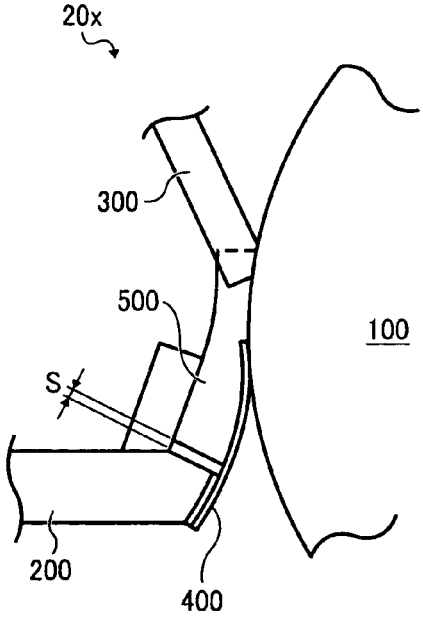
FIG. 12 RELATED ART
FIG. 12 illustrates a gap between a lateral end seal and a casing of the known cleaning device.

It is to be noted that operations of the cleaning devices according to the above-described various embodiments are similar to those described with reference to FIG. 11, and thus descriptions thereof are omitted.

As described above, in the cleaning devices according to the above-described embodiments, the gaps between the lateral end seals and the casing can be prevented with a relatively simple configuration. As a result, the substance such as toner removed from the rotary member (image carrier) can be prevented from leaking. Thus, the above-described embodiments can provide a reliable process cartridge and image forming apparatus that can prevent or reduce image failure, damage to the operators as well as the image forming apparatus resulting from the leakage of the toner.

As can be appreciated by those skilled in the art, although the description above concerns the cleaning device for the image carrier as the rotary member, the above-described embodiments may be applied to a cleaning device for an intermediate transfer belt as the rotary member. Alternatively, the above-described embodiments may be applied to a cleaning device that removes a substance adhering to a surface of a rotary member other than the image carrier and the intermediate transfer belt.

Numerous additional modifications and variations are possible in light of the above teachings. It is therefore to be understood that, within the scope of the appended claims, the disclosure of this patent specification may be practiced otherwise than as specifically described herein.

What is claimed is:

1. A cleaning device for a rotary member, comprising:

a casing including an opening facing the rotary member;

a cleaning member disposed at the opening in the casing to contact a surface of the rotary member and to remove a substance adhering to the surface of the rotary member;

an entrance seal provided at the opening in the casing and disposed upstream from the cleaning member in a direction in which the rotary member rotates to prevent leakage of the substance removed by the cleaning member through a gap between the opening in the casing and the rotary member;

a pair of lateral end seals provided at the opening in the casing and respectively disposed at both end portions of the cleaning member as well as the entrance seal in an axial direction of the rotary member to prevent leakage of the substance removed by the cleaning member from the both end portions, the pair of lateral end seals each having a first face attached to the casing and a second face opposite the first face; and a compressing member attached to the casing, to compress each lateral end seal by pressing the second face of the lateral end seal, the lateral end seal sandwiched between the casing and the compressing member, the compressing member pressing a third face of the lateral end seal perpendicular to the first face and the second face of the lateral end seal against a first surface of the casing in a direction in which the lateral end seal is expanded by the compression.

2. The cleaning device according to claim 1, wherein the compressing member comprises an adhesive member to be adhered to the casing so as to attach the entrance seal to the opening in the casing.

3. The cleaning device according to claim 2, wherein the adhesive member is attached to a second surface of the casing that is adjacent to the lateral end seal, and in a state in which each of the lateral end seals is not pressed by the adhesive member, the second face of the lateral end seal is upstream from the second surface of the casing in a direction in which the adhesive member is attached to the casing.

4. The cleaning device according to claim 2, wherein, the adhesive member is pulled in a direction in which the lateral end seal presses against the casing to be attached to the casing.

5. The cleaning device according to claim 2, wherein the adhesive member comprises double-sided adhesive tape.

6. The cleaning device according to claim 1, wherein the entrance seal is a sheet comprising a material selected from the group consisting of polyethylene terephthalate resin, polyurethane resin, polyphenylether resin, polycarbonate resin, polyethylene resin, and polypropylene resin.

7. The cleaning device according to claim 1, wherein the lateral end seals comprise at least one of a foamed material, a nonwoven fabric, and a woven fabric.

8. The cleaning device according to claim 1, wherein the rotary member is an image carrier on which a toner image is formed.

9. A process cartridge comprising:

a housing;

an image carrier disposed within the housing, on which a toner image is formed; and a cleaning device disposed within the housing to clean a surface of the image carrier, the cleaning device comprising:

a casing including an opening facing the image carrier;

a cleaning member disposed at the opening in the casing to contact the surface of the image carrier and to remove toner adhering thereto;

an entrance seal provided at the opening in the casing and disposed upstream from the cleaning member in a direction in which the image carrier rotates to prevent leakage of the toner removed by the cleaning member through a gap between the opening in the casing and the image carrier;

a pair of lateral end seals provided at the opening in the casing and respectively disposed at both end portions of the cleaning member as well as the entrance seal in an axial direction of the image carrier to prevent leakage of the toner removed by the cleaning member from the end portion, the pair of lateral end seals each having a first face attached to the casing and a second face opposite the first face; and a compressing member attached to the casing, to compress each lateral end seal by pressing the second face of the lateral end seal, the lateral end seal sandwiched between the casing and the compressing member, the compressing member pressing a third face of the lateral end seal perpendicular to the first face and the second face of the lateral end seal against a first surface of the casing in a direction in which the lateral end seal is expanded by the compression.

10. The process cartridge according to claim 9, further comprising a storage portion provided integrally with the housing to store the toner removed from the image carrier by the cleaning member.

11. The process cartridge according to claim 9, wherein the housing comprises injection-molded resin.

12. The process cartridge according to claim 11, wherein the housing comprises at least one of polycarbonate resin, acrylic nitrile butadiene styrene resin, nitrile styrene resin, polyphenylene oxide resin, and polyether terephthalate resin.

13. An image forming apparatus comprising:

at least one process cartridge detachably attachable to the image forming apparatus;

an image carrier disposed within the process cartridge, on which a toner image is formed;

a transfer unit to transfer the toner image from the image carrier onto a sheet of recording media; and a cleaning device disposed within the process cartridge to clean a surface of the image carrier;

the cleaning device comprising:

a casing including an opening facing the image carrier;

a cleaning member disposed at the opening in the casing to contact the surface of the image carrier and to remove toner adhering thereto;

an entrance seal provided at the opening in the casing and disposed upstream from the cleaning member in a direction in which the image carrier rotates to prevent leakage of the toner removed by the cleaning member through a gap between the opening in the casing and the image carrier;

a pair of lateral end seals provided at the opening in the casing and respectively disposed both end portions of the cleaning member as well as the entrance seal in an axial direction of the image carrier to prevent leakage of the toner removed by the cleaning member from the both end portions, the pair of lateral end seals each having a first face attached to the casing and a second face opposite the first face; and a compressing member attached to the casing, to compress each lateral end seal by pressing the second face of the lateral end seal, the lateral end seal sandwiched between the casing and the compressing member, the compressing member pressing a third face of the lateral end seal perpendicular to the first face and the second face of the lateral end seal against a first surface of the casing in a direction in which the lateral end seal is expanded by the compression.

14. The image forming apparatus according to claim 13, comprising at least two process cartridges each of which forms a different single-color toner image.

15. The cleaning device according to claim 1, wherein the first surface of the casing is an edge face defining a longitudinal end of the opening and facing the third face of the lateral end seal, the lateral end seal is attached to a face of the casing adjacent to the first surface of the casing, and the lateral end seal compressed by the compressing member expands to reduce in size of a clearance in a space defined by the compressing member, the first surface of the casing, and the face of the casing facing the first face of the lateral end seal.

* * * * *